United States Patent [19]

Ceglowski

[11] 4,280,769

[45] Jul. 28, 1981

[54] JOINT AND FRAMEWORK

[75] Inventor: Jerzy W. Ceglowski, Durban North, South Africa

[73] Assignee: Universal Framework Coupling (Proprietary) Limited, South Africa

[21] Appl. No.: 41,740

[22] Filed: May 23, 1979

[30] Foreign Application Priority Data

May 24, 1978 [ZA] South Africa ..... 78/2992

[51] Int. Cl.[3] ..... F16B 7/04

[52] U.S. Cl. ..... 403/218; 403/171

[58] Field of Search ..... 403/217, 218, 219, 170, 403/171, 172, 174, 175, 176, 178; 52/650, 655

[56] References Cited

U.S. PATENT DOCUMENTS

| | | | |
|---|---|---|---|
| 2,886,359 | 5/1959 | Herrschaft | 403/171 |
| 3,563,581 | 2/1971 | Sommerstein | 403/217 |
| 3,912,410 | 10/1975 | Pofferi | 403/170 |

FOREIGN PATENT DOCUMENTS

| | | | |
|---|---|---|---|
| 722310 | 7/1942 | Fed. Rep. of Germany | 403/218 |
| 91271 | 4/1968 | France | 403/218 |
| 619609 | 8/1978 | U.S.S.R. | 403/217 |

*Primary Examiner*—Andrew V. Kundrat

[57] ABSTRACT

A coupling for coupling together a plurality of elongate members, particularly members of a planar framework structure, which coupling includes a separate coupling element welded to each one of the members to be coupled together and a locking ring which is received within a groove in each of the coupling elements. A frusto-pyramidal expansion member is received within a space between the coupling elements within the locking ring and when urged further into said space forces the coupling elements radially outwardly thus frictionally securing the locking ring against the inner walls of the grooves. Further members of the framework structure may also be coupled to the coupling by clamping an end of such members between the locking ring and the inner wall of the grooves.

16 Claims, 9 Drawing Figures

JOINT AND FRAMEWORK

BACKGROUND TO THE INVENTION

This invention relates to a coupling. In particular the invention relates to a coupling for coupling together a plurality of members and, more particular, members of a planar framework structure. Furthermore the invention relates to a coupling element for such a coupling, a framework structure including such a coupling and to a method of coupling together a plurality of members.

SUMMARY OF THE INVENTION

According to the invention there is provided a coupling for coupling together a plurality of members, the coupling including at least two coupling elements, each coupling element being securable to a different one of the members and each coupling element having an engagement shoulder;

a locking ring which is engageable with the shoulder of each coupling element; and a biassing means for biassing the locking ring and the coupling elements into engagement with each other.

The shoulder may be defined by a wall of a groove in the coupling element.

The coupling elements may define a space between them when engaged with the locking ring and the biassing means may include a first tapered expansion member which is receivable in the space between the coupling elements and is adapted to displace the coupling elements outwardly into engagement with the locking ring.

In this configuration the coupling elements may each have an end surface complementary to the outer surface of the first tapered expansion member, the end surfaces being engaged by the expansion member.

The coupling may further include an urging means for urging the first expansion member into the space to thereby displace the coupling elements into engagement with the locking ring.

The space between the coupling elements may be open at opposite ends and the coupling includes a second tapered expansion member, the first expansion member being receivable in the space from one side and the second expansion member being receivable in the space from the other side, the urging means being adapted to urge the first and second expansion members together. For this arrangement, the coupling elements may each have two angled end surfaces that are engaged by the first and second expansion members respectively.

The first and second expansion members are screw-threadedly coupled.

The locking ring and the coupling elements may engage each other frictionally. Alternatively or in addition the locking ring and the coupling elements may have complementary engaging formations to mechanically lock them together.

The coupling elements may be suitably shaped for a predetermined number to be positioned in abutment with one another to form an annulus with their shoulders being adjacent one another to form a continuous shoulder to which the locking ring is engageable.

Furthermore, the coupling elements may be secured to the members to be coupled together.

Conveniently the grooves of the coupling elements may be sufficiently wider than the locking ring for an end of a connecting member to be inserted between the locking ring and a wall of the groove to be locked therebetween.

The invention thus extends to a coupling in combination with a connecting member having an end portion insertable between the wall of the groove and the locking ring.

The locking ring may also have a portion that is exposed when the locking ring is engaged with the coupling elements, connecting members being securable to the locking ring at said portion.

Additionally the biassing means may be adapted to have a connecting member secured thereto.

The invention further extends to a coupling in which the locking ring is received adjacent the engagement shoulders of the coupling element and the biassing means biasses the coupling elements and the locking ring into engagement with each other.

Further according to the invention there is provided a coupling element for a coupling in accordance with the invention, which has an engagement shoulder to which a locking ring is engageable.

The coupling element may have angled abutting surfaces such that a predetermined number of similar coupling elements may be positioned adjacent one another to form an annulus having a polar axis with abutting surfaces of the coupling elements in abutment with one another. Conveniently the abutting surfaces are planar and are disposed such that they are radially disposed with respect to the polar axis when positioned adjacent similar coupling elements to form the annulus.

Furthermore the coupling element may have at least one end surface that is disposed at an angle to the engagement shoulder such that when the coupling element is engaged with the locking ring the end surface is at an angle to the polar axis of the locking ring. More particularly the coupling element may have two end surfaces that are disposed at complementary angles to the engagement shoulders.

Still further according to the invention there is provided a framework structure having a number of elongate structural elements that are coupled together by a coupling in accordance with the invention.

In addition according to the invention there is provided a method of coupling together a plurality of members, which includes:

securing to an end of each member a coupling element having an engagement shoulder;

positioning a locking ring adjacent the shoulder of the coupling elements; and displacing the coupling elements outwardly to lock the locking ring with respect to the shoulder.

The method may include inserting a flat end of a connecting member between the locking ring and the shoulder of a groove prior to displacing of the coupling elements.

The coupling elements may be displaced by urging a tapered expansion member between the ends of the coupling elements located within the locking ring.

BRIEF DESCRIPTION OF THE DRAWINGS

The invention is now described by way of an example with reference to the accompanying drawings, in which.

DETAILED DESCRIPTION OF THE DRAWINGS

Figure 1:
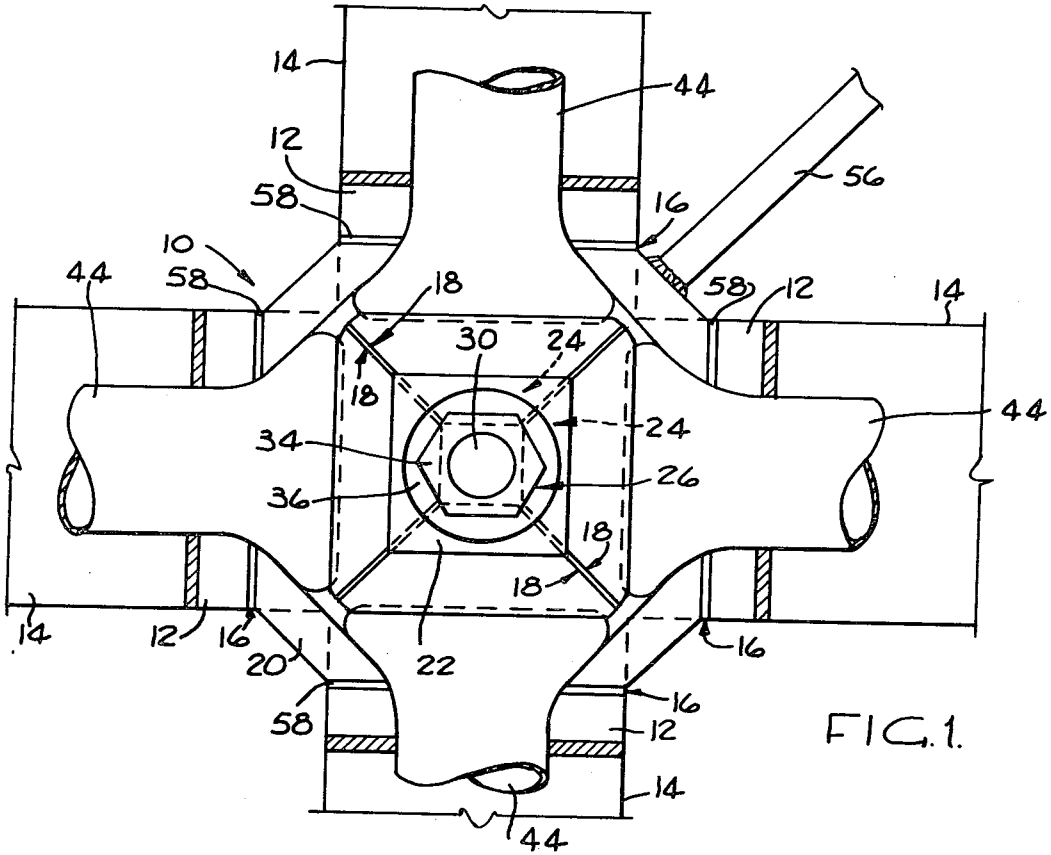
FIG. 1 shows a plan view of a coupling in accordance with the invention.

Referring now to the drawings a coupling in accordance with the invention is generally indicated by the reference numeral 10. The coupling 10 includes coupling elements 12 secured to members 14 to be coupled together, by welding or the like.

Figure 3:
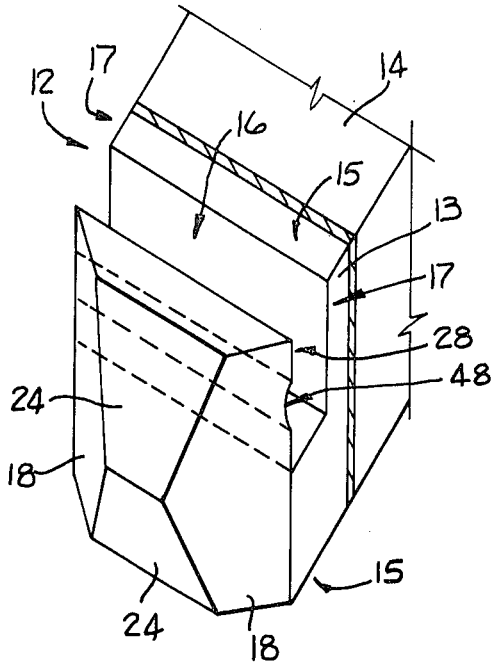
FIG. 3 shows a three-dimensional view of a coupling element for the coupling of FIG. 1.

Each coupling element 12 has a rectangular body 13 with two sets of opposed sides 15 and 17. Close to one end, the elements 12 have a groove 16 in one of the sides 15 which extends halfway into the body member 13 and also opens in the sides 17. The said end is convex pyramidal being defined by planar side surfaces 18 and front surfaces 24. As seen in FIG. 3 the side surfaces 18 intersect the sides 17 at 135 degrees and are at an angle to each other of 90 degrees. The front surfaces 24 intersect the sides 18 at 110 degrees and one another at 140 degrees. Thus, the side surfaces 18 intersect the front surfaces 24. In an inner wall 28 of the groove 16 closest to the said end there is an indentation 48. As shown in FIG. 3 the members 14 are secured to the coupling elements 12 at their ends opposite to the convex ends defined by the side surfaces 18 and the front surfaces 24.

Figure 2:
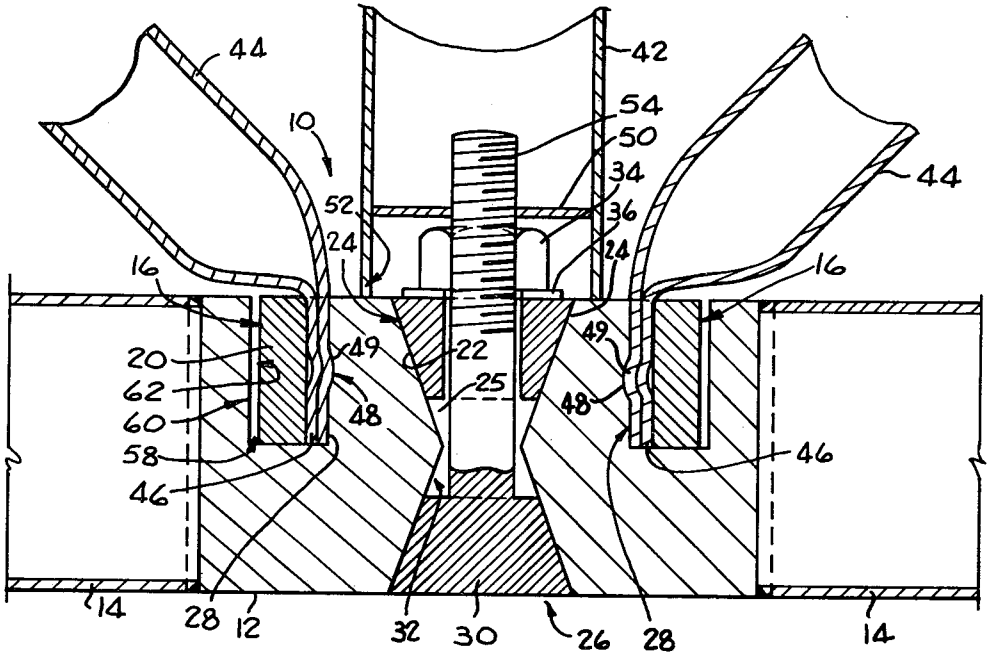
FIG. 2 shows a cross-sectional side view of the coupling of FIG. 1 along line II—II of FIG. 1.

In use, the side surfaces 18 of four coupling elements 12 abut one another with their grooves 16 in communication with one another to define an annularly square channel and the front surfaces 24 define two frustopyramidal cavities 25 and 32 (as shown in FIG. 2). These cavities both taper inwardly.

The coupling further has a square locking ring 20 which is received in the channel defined by the grooves 16 of four abutting coupling elements 12. As is seen in FIG. 1, the corners of the locking ring 20 are cut-off.

A frusto-pyramidal expansion member 22 is also provided which is receivable in the cavity 25 defined by four abutting coupling elements 12. The expansion member 22 has four planar surfaces which are complementary to and which engage one set of the front surfaces 24 of the four abutting coupling elements 12 defining the cavity 25.

A bolt and nut arrangement 26 is provided whereby the expansion member 22 can be forced into the cavity 25 thereby forcing the coupling elements 12 radially outwardly and thus frictionally securing the locking ring 20 against the inner walls 28 of the grooves 16. The head of the bolt 30 of the bolt and nut arrangement 26 is also frusto-pyramidal and fits into the cavity 32 defined by the coupling elements 12, so as to act in the opposite direction to the expansion member 22 upon tightening of the bolt and nut arrangement. Preferably a washer 36 is provided between the nut 34 and the bolt and nut arrangement 26 and the conical member 22.

Figure 9:
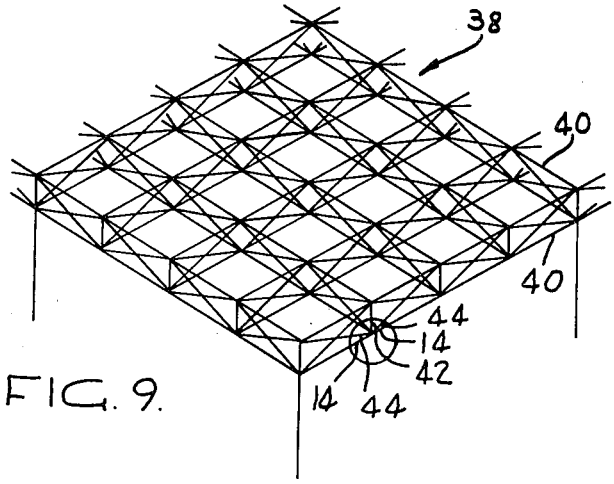
FIG. 9 shows a three dimensional embodiment of a planar framework in accordance with the invention.

Particularly for use in planar frameworks 38, as shown in FIG. 9, where two planar framework layers 40 are connected together, vertical and diagonal connecting members 42 and 44 respectively are provided to connect such layers 40 together. The free ends 46 of the diagonal connecting members 44 are flattened and are also secured within the grooves 16 between the locking ring 20 and the inner walls 28 of the coupling elements 12 (see particularly FIG. 2). In this way both the members 14 and the connecting members 44 are secured together frictionally by means of the coupling 10. Where diagonal members 44 cross one another they may be joined together by a wire ring (not shown) or alternatively may be joined together by a bolt and nut arrangement (not shown), the regions where the diagonal members cross one another being flattened.

The abutting surfaces between the coupling elements 12 and the diagonal connecting members 44 engage one another mechanically as the ends of the connecting members 44 have ridges 49 that seat in the indentations 48. Alternatively or in addition the abutting surfaces of the coupling elements 12, the diagonal connecting members 44 and the locking ring 20 may be roughened to enhance frictional engagement therebetween. Furthermore a pin (not shown) may be passed through the bolt 30 immediately above the nut 34 to resist loosening of the coupling 10.

The vertical coupling elements 42 may be in the form of tubular elements having a web 50 secured internally therein near the ends 52 thereof. Said webs 50 may be threaded and can hence merely screw onto the free end 54 of the bolt 30 of the bolt and nut arrangement 26. By substituting the bolt with a stud (not shown) such vertical coupling elements 42 can extend in both vertical directions upwardly and downwardly from the coupling 10.

Figure 5:
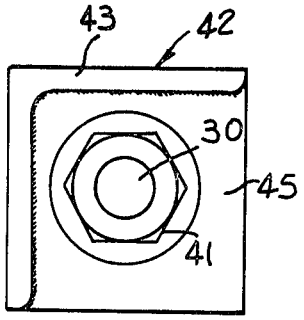
FIG. 5 shows a plan view of the coupling of FIG. 4.
Figure 4:
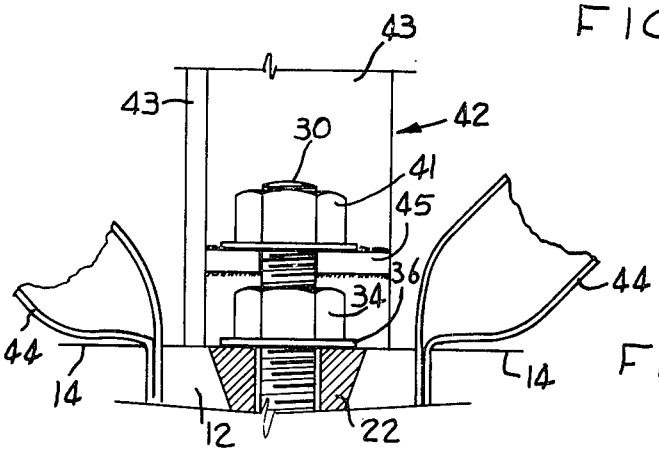
FIG. 4 shows a side view of part of the coupling of FIG. 1 including a vertical connecting member.

In an additional arrangement the vertical connecting members 42 may be angled sections having two angled portions 43 as shown in FIGS. 4 and 5. The portions 43 have a web 45 secured thereto whereby the members 42 can be secured by means of a further nut 41 tightening the web between the nut 34 and said nut 41.

In addition bracing members 56 may be welded onto unoccupied portions of the locking ring 20, as shown in FIG. 1, to provide reinforcement to frameworks. In an alternative embodiment the members 56 may serve as attachment members for bracing members to be attached thereto by for example bolts and nuts (not shown).

Figure 6:
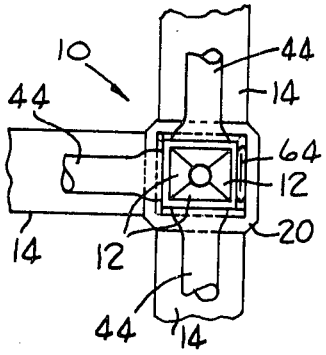
FIG. 6 shows a plan view of the coupling of FIG. 1 as used in a side joint of a planar framework.

With the coupling 10 in its assembled configuration, as shown particularly in FIG. 2, a gap 58 remains between the outer walls 60 of the grooves 16 and the outer surface 62 of the locking ring 20. The magnitude of this gap 58 may provide an indication whether the bolt and nut arrangement 26 has been tightened sufficiently.

Where the coupling 10 only couples together three connecting members 44 as shown in FIG. 6 the space left where the end of the fourth connecting member 44 should have been inserted may be filled with a packing element 64 to ensure proper securing of the three connecting members 44. Similarly, packing elements 64 may be used where the thickness of the connecting members 44 are thinner than usual, thus ensuring uniform clamping.

Figure 7:
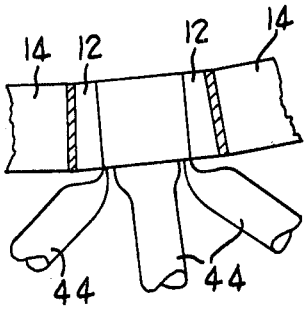
FIGS. 7 and 8 show how a camber can be provided within a framework using the coupling of FIG. 1.
Figure 8:
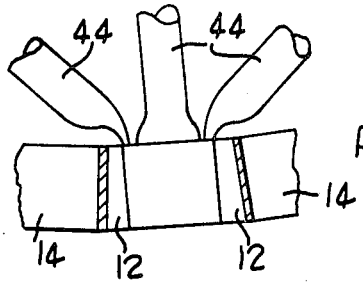

In order to provide a camber within a substantially planar framework, the coupling elements 12 may be secured to the members 14 at an angle, as shown in FIGS. 7 and 8, so that when the coupling elements 12 are ordinarily coupled together such a camber is automatically provided.

FIG. 9 shows a typical planar framework 38 comprising two layers 40 connected together by vertical and diagonal connecting members 42 and 44 respectively. The members 14 are thus typically the booms of the framework. Comparing FIGS. 2 and 9, corresponding members of the framework are particularly indicated within the encircled region.

Furthermore, when more than four booms or other members are to be coupled together at a single point the locking ring 20 and the coupling elements 12 may be accordingly adapted, for example, it may be octagonel to couple together eight members 14.

Planar frameworks incorporating couplings 10 may be particularly used for roofs of large spans, pedestrian bridges, pipe bridges, conveyor gantries, wall framing or any other suitable purpose where planar frameworks of any number of layers are required.

Planar frameworks are simple to assemble by means of the couplings 10 and can also be easily disassembled and re-used.

I claim:

1. A coupling for coupling together a plurality of members, the coupling including a plurality of coupling elements, each coupling element being securable to a different one of the members and each coupling element having at least one groove therein, with a wall of the groove defining an engagement shoulder, the coupling elements further being configured and arranged adjacent one another in an annular manner to define a central space having a polar axis;

a locking ring received in the grooves with its polar axis parallel to the polar axis of the central space and engaged with the engagement shoulder of each element; and a biassing means located in the central space engaging the elements and biassing the shoulders of the elements into locking engagement with the locking ring.

2. A coupling as claimed in claim 1, in which the coupling elements define the central space between them when engaged with the locking ring and the biassing means includes a first tapered expansion member which is receivable in the space between the coupling elements and is adapted to displace the coupling elements outwardly into engagement with the locking ring.

3. A coupling as claimed in claim 2, in which the coupling elements each have an end surface complementary to the outer surface of the first tapered expansion member, the end surfaces being engaged by the expansion member.

4. A coupling as claimed in claim 2, which includes an urging means for urging the first expansion member into the space to thereby displace the coupling elements into engagement with the locking ring.

5. A coupling as claimed in claim 4, in which the space between the coupling elements is open at opposite ends and the coupling includes a second tapered expansion member, the first expansion member being receivable in the space from one side and the second expansion member being receivable in the space from the other side, the urging means being adapted to urge the first and second expansion members together.

6. A coupling as claimed in claim 5, in which the coupling elements each have two angled end surfaces that are engaged by the first and second expansion members respectively.

7. A coupling as claimed in claim 5, in which the first and second expansion members are screw-threadedly coupled.

8. A coupling as claimed in claim 1, in which the locking ring and the coupling elements engage each other frictionally.

9. A coupling as claimed in claim 1, in which the locking ring and the coupling elements have complementary engaging formations to mechanically lock them together.

10. A coupling as claimed in claim 1, in which the coupling elements form an annulus with their grooves being in communication with one another to form a channel in which the locking ring is receivable.

11. A coupling as claimed in claim 1, in which the coupling elements are secured to the members to be coupled together.

12. A coupling as claimed in claim 1, in which the grooves of the coupling elements are sufficiently wider than the locking ring for an end of a connecting member to be inserted between the locking ring and a wall of the groove to be locked therebetween.

13. A coupling as claimed in claim 12, in combination with a connecting member having an end portion insertable between the wall of the groove and the locking ring.

14. A coupling as claimed in claim 1, in which the locking ring has a portion that is exposed when the locking ring is engaged with the coupling elements, connecting members being securable to the locking ring at said portion.

15. A coupling as claimed in claim 1, in which the biassing means is adapted to have a connecting member secured thereto.

16. A coupling as claimed in claim 1, in which the locking ring is received adjacent the engagement shoulders of the coupling element and the biassing means biasses the coupling elements and the locking ring into engagement with each other.

* * * * *